US010486881B2

(12) United States Patent
Wigman et al.

(10) Patent No.: US 10,486,881 B2
(45) Date of Patent: Nov. 26, 2019

(54) FLEXIBLE PACKAGES WITH CLOG RESISTANT DEGASSING VALVE AND METHODS OF MAKING THE SAME

(71) Applicant: Fres-co System USA, Inc., Telford, PA (US)

(72) Inventors: Daniel Wigman, Harleysville, PA (US); Travis Blose, Telford, PA (US); Ronald Karl Long, Pennsburg, PA (US); Sergio Muniz, Philadelphia, PA (US)

(73) Assignee: Fres-co System USA, Inc., Telford, PA (US)

( * ) Notice: Subject to any disclaimer, the term of this patent is extended or adjusted under 35 U.S.C. 154(b) by 119 days.

(21) Appl. No.: 15/787,180

(22) Filed: Oct. 18, 2017

(65) Prior Publication Data

US 2018/0162623 A1 Jun. 14, 2018

Related U.S. Application Data

(60) Provisional application No. 62/432,135, filed on Dec. 9, 2016.

(51) Int. Cl.
*B65D 77/22* (2006.01)
*B65D 81/20* (2006.01)

(52) U.S. Cl.
CPC ..... *B65D 77/225* (2013.01); *B65D 81/2023* (2013.01); *B65D 81/2061* (2013.01); *B65D 81/2084* (2013.01)

(58) Field of Classification Search
CPC ..... B65D 31/10; B65D 33/01; B65D 81/01; B65D 81/2023; B65D 81/2061; B65D 81/2084
See application file for complete search history.

(56) References Cited

U.S. PATENT DOCUMENTS

| | | | |
|---|---|---|---|
| 3,595,467 | A | 7/1971 | Goglio |
| 3,799,427 | A | 3/1974 | Goglio |
| 4,310,118 | A | 1/1982 | Kisida et al. |
| 4,359,467 | A | 11/1982 | Vorbruggen et al. |

(Continued)

FOREIGN PATENT DOCUMENTS

| | | | |
|---|---|---|---|
| EP | 1067058 | A1 | 1/2001 |
| EP | 1650139 | A1 | 4/2006 |
| WO | 2014/009527 | A1 | 1/2014 |

OTHER PUBLICATIONS

International Search Report for PCT/US2017/064611 dated Apr. 10, 2018.

*Primary Examiner* — Derek J Battisti
(74) *Attorney, Agent, or Firm* — Caesar Rivise, PC

(57) ABSTRACT

A flexible package with a one-way, pressure-equalizing or degassing valve and method of making the same is provided. The package includes a tortuous path preventing particulate materials, e.g., fine powders, from clogging or interfering with opening and closing of said valve. The package includes a heat seal including discontinuities or gaps which defines a tortuous path between the valve and the compartment within the package in which the particulate material is located, allowing air and internal gases trapped in the package to escape through the valve while preventing fine powders, dust and particulate from reaching the valve body by trapping or collecting them in the tortuous path.

7 Claims, 4 Drawing Sheets

(56) References Cited

U.S. PATENT DOCUMENTS

| | | | | |
|---|---|---|---|---|
| 4,420,015 | A | 12/1983 | Blaser | |
| 4,444,219 | A | 4/1984 | Hollenstein | |
| 4,576,285 | A | 3/1986 | Goglio | |
| 4,890,637 | A | 1/1990 | Lamparter | |
| 4,913,561 | A | 4/1990 | Beer | |
| 5,060,803 | A | 10/1991 | Beer et al. | |
| 5,547,694 | A | 8/1996 | Perry et al. | |
| 5,927,336 | A | 7/1999 | Tanaka et al. | |
| 6,070,728 | A | 6/2000 | Overby et al. | |
| 7,040,483 | B2 * | 5/2006 | Inuzuka ..... | B65D 75/5855 206/219 |
| 7,972,064 | B2 | 7/2011 | Anderson | |
| 2005/0031229 | A1 | 2/2005 | Tang | |
| 2009/0226573 | A1 | 9/2009 | Leon et al. | |

* cited by examiner

Fig. 4
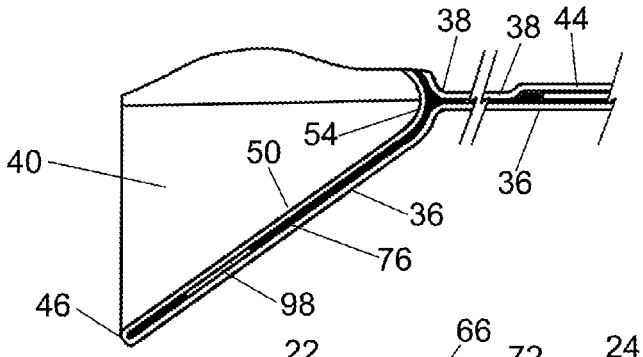
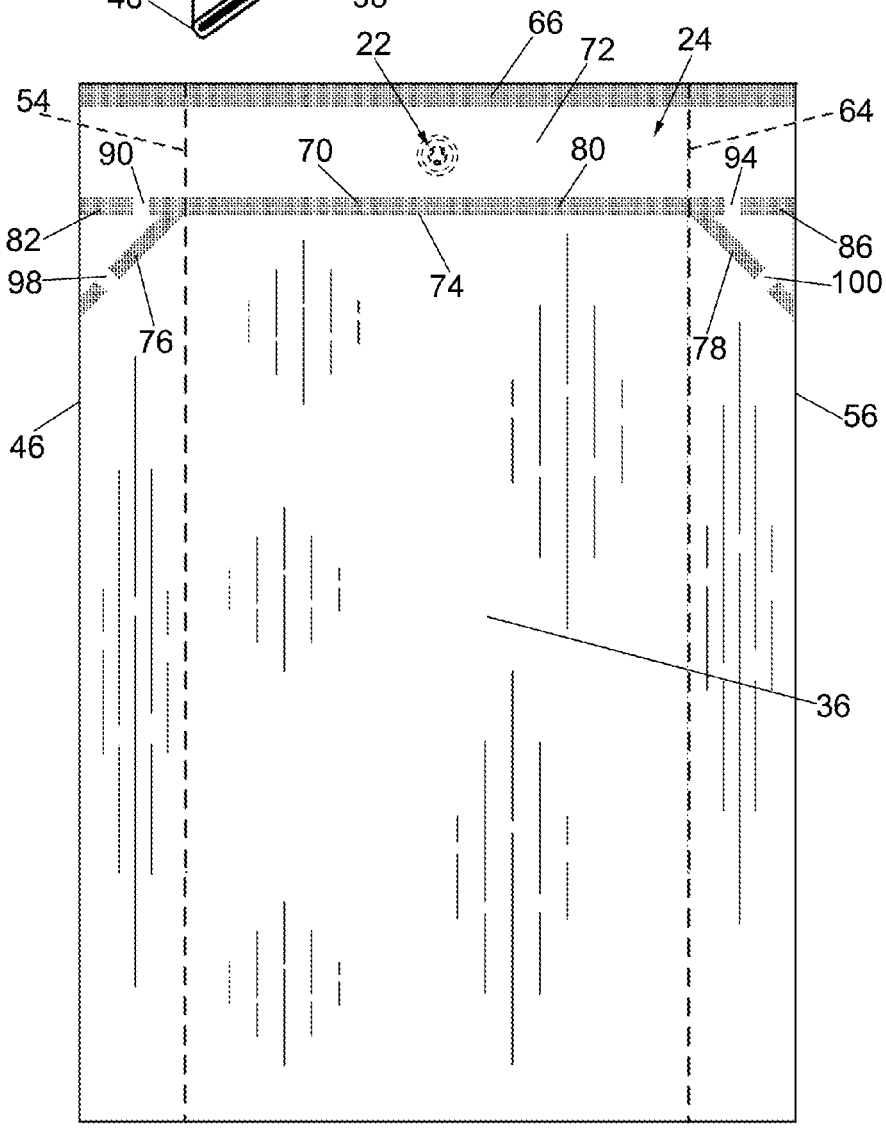
Fig. 5

Fig. 6
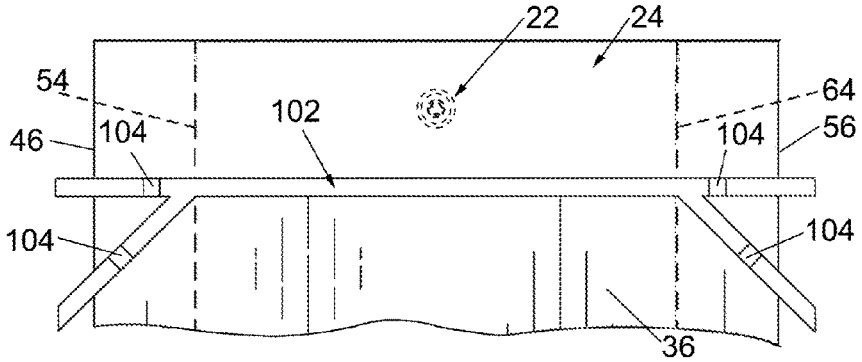
Fig. 7
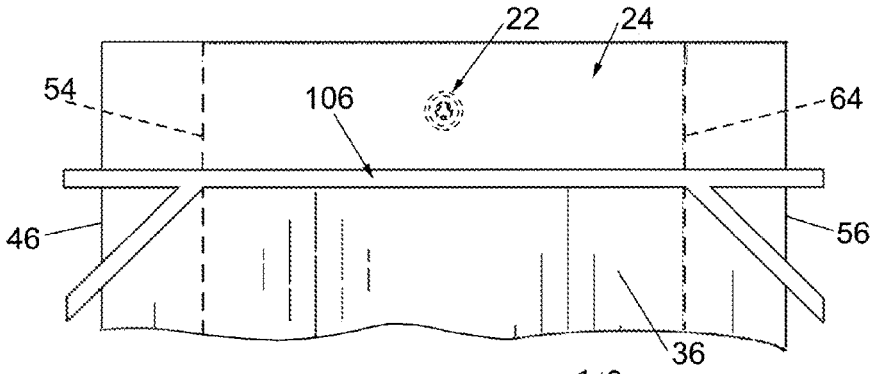
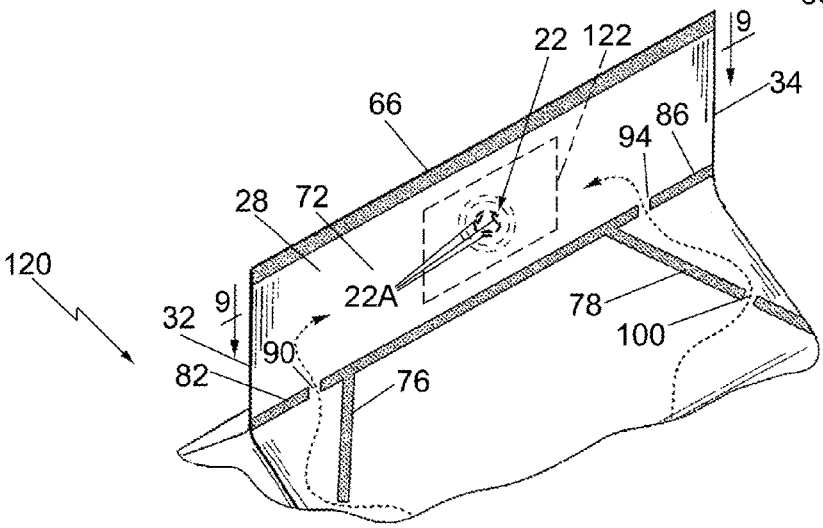
Fig. 8
Fig. 9
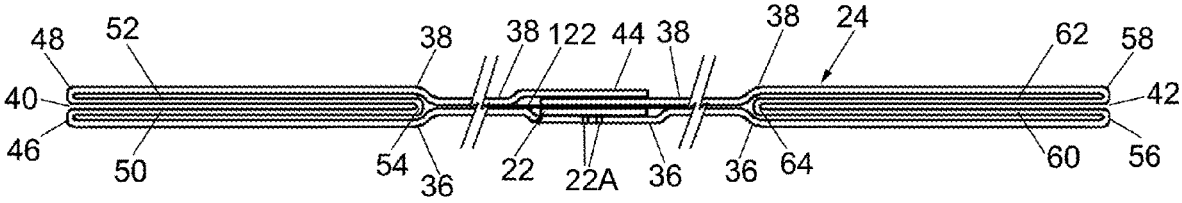

Fig. 10
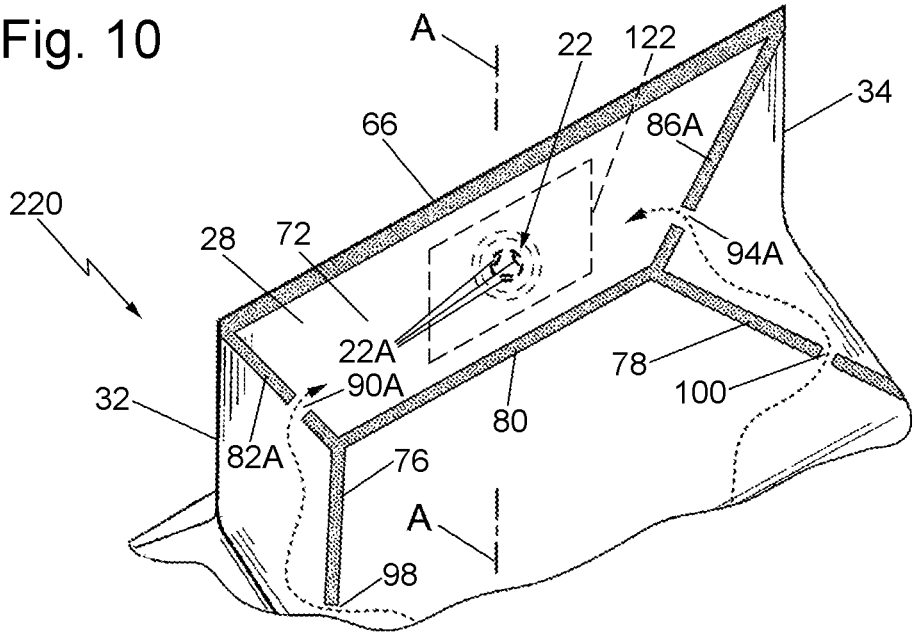
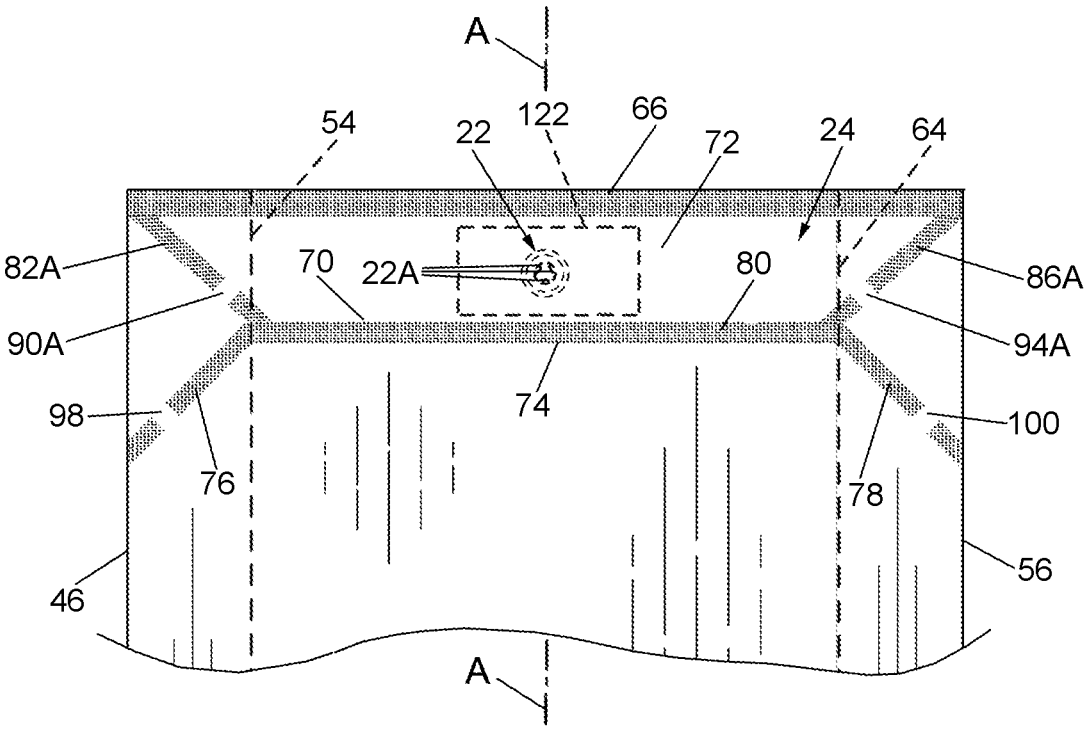
Fig. 11

FLEXIBLE PACKAGES WITH CLOG RESISTANT DEGASSING VALVE AND METHODS OF MAKING THE SAME

CROSS REFERENCE TO RELATED APPLICATIONS

This application claims priority from provisional application Ser. No. 62/432,135, filed on Dec. 9, 2016, entitled Flexible Packages With Clog Resistant Degassing Valve And Methods Of Making The Same, which application is assigned to the same assignee as the subject invention and whose disclosure is specifically incorporated by reference herein.

BACKGROUND OF THE INVENTION

Field of Invention

This invention relates generally to flexible packages and more particularly to flexible packages including a one way degassing or pressure equalizing valve, which due to the construction of the package is resistant to clogging and methods of making such packages.

Description of Related Art

This invention relates generally to flexible packages, and more particularly to flexible packages for holding products in a hermetically sealed condition, e.g., isolated from the ambient atmosphere, while allowing air and other gases to escape from the package, thereby de-pressuring and reducing internal volume.

As is well known the major advantages of flexible packaging, as compared to relatively rigid packaging, e.g., cartons, are that until the flexible package is filled it takes up very little volume, and after it is emptied of its contents it readily collapses, thereby reducing its volume to approximately that of the unfilled package. The former characteristic is a significant advantage insofar as storage is concerned, while the latter characteristic is a significant advantage from the standpoint of disposability. One common type of flexible package for holding goods under vacuum until the package is opened is the so-called "gusseted" package or bag. Typically, such a package is formed from a web of flexible stock material, e.g., polyethylene, polyester, polypropylene, metal foil, and combinations thereof in single or multiple plies, into a tubular body, having a face panel, a back panel, and a pair of gusseted sides. Each gusseted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under hermetic seal until the bag is opened.

Various types of flexible packages for holding dry goods, powders or other particulate materials under hermetic conditions have been disclosed in the patent literature and are commercially available today. Examples of such packages are found in the following U.S. Pat. Nos. 4,359,467 4,310, 118, 4,576,285, and 4,913,561. During the bag filling process, air is typically entrapped within the sealed bag, making the incorporation of a one-way degassing valve into an area of a wall of the bag advantageous. Air trapped within a sealed flexible package can produce breakage when bags are palletized or dropped in the absence of a degassing or pressure relief valve. Furthermore, some packaged products off-gas (degas), requiring a pressure relief valve to allow the gasses produced over time after the packaging process to escape. The one-way valve enables those gases to escape while preventing environmental air ingress. Thus, it is a common practice to incorporate one-way degassing valves in hermetically sealed, flexible packages to enable any gasses trapped during the sealing process or produced by the particulate material within the package to exit from the package, while preventing air from entering into the package through the valve. Examples of such one-way degassing valves are shown in U.S. Pat. Nos. 3,595,467, 3,799,427 4,420,015, and 4,444,219.

A long known problem with the use of one-way degassing valves for packaged dry goods is the potential for clogging the valve with fines, powders or dust (particulates) of the product enclosed in the package. The particulates can travel with the air moving toward and through the valve, thereby fouling the valve seal mechanism by either clogging the path of entrained gas escaping, or by holding the path open to allow environmental air to reenter the package. Several means of preventing this clogging have been disclosed in the prior art. They most commonly use filter media or valve construction details to separate air from particulate, but can be expensive, unreliable or allow clogging to continue with extremely small particulate size materials. Further improvements to prevent fine powders, particulates and other packaged goods from clogging one-way degassing valves are disclosed in U.S. Pat. Nos. 4,890,637, 5,547,694, 5,927,336, 6,070,728, and 7,972,064.

While the aforementioned packages may be generally suitable for their intended purposes, they suffer from one or more drawbacks, e.g., effectiveness, simplicity and ease of construction, cost. The subject invention addresses the needs of the prior art.

SUMMARY OF THE INVENTION

One aspect of this invention is a flexible package for holding a particulate material therein. The package basically comprises a one-way degassing or pressure equalizing valve and a bag. The bag has a top portion, a bottom portion, a first side, an oppositely disposed second side, and a longitudinally extending axis. The bag is formed of a flexible sheet material comprising a front panel, a rear panel, a top transverse seal line, a bottom transverse seal line, and an intermediate seal line. The top transverse seal line is located in the top portion of the bag. The bottom transverse seal line is located in the bottom portion of the bag. The intermediate seal line is located between the top transverse seal line and the bottom transverse seal line. The panels of the bag between the bottom transverse seal line and the intermediate seal line form a compartment configured for receipt of the particulate material therein. The panels of the bag between the intermediate seal line and the top transverse seal line form a vent space in which the valve is located. The valve is in communication with the vent space and the ambient atmosphere outside of the bag. The intermediate seal line comprises a central section, a first end section and a second end section. The central section has a length extending transversely with respect to the longitudinal axis and has a first end. The first end section has a first length. The first end section forms an extension of the central section from the first end of the central section. The second end section has a second length. The second end section forms an extension of the central section from the first end of the central section and extends at an acute angle to the longitudinal axis. The central section secures the panels together along the length of the central section. The first end section secures the panels together along the first length except for a short gap in the first end section at which the panels are unsecured to each other. The second end section secures the panels together along the second length except for a short gap in the second end section at which the panels are unsecured to each other. The gaps form a tortuous path configured to enable gas to flow therethrough from the compartment to the vent space while reducing the chances of the particulate material gaining access to the valve.

In accordance with one aspect of the package of this invention the first end section is collinear with the central section.

In accordance with another aspect of the package of this invention the second end section extends at an acute angle to the longitudinal axis.

In accordance with another aspect of the package of this invention the intermediate seal line additionally comprises a third end section. The third end section has a third length and forms an extension of the central section from the first end of the central section. The third end section extends at an acute angle to the longitudinal axis. The bag is a gusseted bag having a first gusseted side panel secured between the front panel and the rear panel at the first side by a pair of outer fold edges. The first gusseted side panel comprises a front gusset section and a rear gusset section connected to each other by an inner fold edge located between the outer fold edges, wherein the first end section secures the front panel to the front gusset section along the first length of the first end section except for the short gap at which the front panel is unsecured to the front gusset section. The first end section also secures the rear panel to the rear gusset section along the first length of the first end section except for a short gap at which the rear panel is unsecured to the rear gusset section. The second end section secures the front panel to the front gusset section along the second length of the second end section except for the short gap at which the front panel is unsecured to the front gusset section. The second end section also secures the rear panel to the rear gusset section along the second length of the second end section except for a short gap at which the rear panel is unsecured to the rear gusset section.

In accordance with another aspect of the package of this invention the panels include respective inner surfaces which are heat sealed to each other along the intermediate seal line except where the gaps are located.

In accordance with another aspect of the package of this invention the front panel, the rear panel and the first gusseted side panel each include respective inner surfaces which are heat sealed to each other along the intermediate seal line.

In accordance with another aspect of the package of this invention the panels each include respective inner surfaces and wherein the intermediate seal line includes peelable coating areas on the inner surfaces at the location of the gaps, whereupon internal pressure generated within the bag causes the peelable coating areas to break to thereby create the gaps.

In accordance with another aspect of the package of this invention the front panel, the rear panel and the first gusseted side panel each include respective inner surfaces and wherein the intermediate seal line includes peelable coating areas on the inner surfaces at the location of the gaps, whereupon internal pressure generated within the bag causes the peelable coating areas to break to thereby create the gaps.

In accordance with another aspect of the package of this invention the package additionally comprises a second gusseted side panel secured between the front panel and the rear panel at the second side by a second pair of outer fold edges. The second gusseted side panel is constructed similarly to the first gusseted side panel.

In accordance with another aspect of the package of this invention the package additionally comprises a filter located within the vent space and configured to prevent any particulate material which enters the vent space from gaining ingress into the valve.

Another aspect of this invention entails a method of making a flexible package for holding a particulate material therein. The method comprises providing a bag having a top portion, a bottom portion, a first side and an oppositely disposed second side. The bag is formed of a flexible sheet material comprising a front panel, a rear panel. A one-way degassing or pressure equalizing valve is applied to one of the front and a rear panels. A top transverse seal line is formed across the bag at the top portion thereof. A bottom transverse seal line is formed across the bag at the bottom portion thereon. An intermediate seal line is formed between the top transverse seal line and the bottom transverse seal line, The panels of the bag between the bottom transverse seal line and the intermediate seal line form a compartment configured for receipt of the particulate material therein, The panels of the bag between the intermediate seal line and the top transverse seal line form a vent space. The valve is in communication with the vent space, the intermediate seal line comprises a central section, a first end section and a second end section. The central section has a length extending transversely with respect to the longitudinal axis and has a first end. The first end section has a first length. The first end section forms an extension of the central section from the first end of the central section. The second end section has a second length. The second end section forms an extension of the central section from the first end of the central section and extends at an acute angle to the longitudinal axis. The central section secures the panels together along the length of the central section. The first end section secures the panels together along the first length except for a short gap in the first end section at which the panels are unsecured to each other. The second end section secures the panels together along the second length except for a short gap in the second end section at which the panels are unsecured to each other. The compartment is filled with the particulate material. The gaps form a tortuous path configured to enable gas to flow therethrough from the particulate material in the compartment to the vent space while reducing the chances of the particulate material gaining access to the valve.

In accordance with one aspect of the method of this invention the first end section is collinear with the central section.

In accordance with another aspect of the method of this invention the second end section extends at an acute angle to the longitudinal axis.

In accordance with another aspect of the method of this invention the intermediate seal line additionally comprises a third end section. The third end section has a third length and forms an extension of the central section from the first end of the central section. The third end section extends at an acute angle to the longitudinal axis. The bag is a gusseted bag having a first gusseted side panel secured between the front panel and the rear panel at the first side by a pair of outer fold edges. The first gusseted side panel comprises a front gusset section and a rear gusset section connected to each other by an inner fold edge located between the outer fold edges. The first end section secures the front panel to the front gusset section along the first length of the first end section except for the short gap at which the front panel is unsecured to the front gusset section. The first end section also secures the rear panel to the rear gusset section along the first length of the first end section except for a short gap at which the rear panel is unsecured to the rear gusset section. The second end section secures the front panel to the front gusset section along the second length of the second end section except for the short gap at which the front panel is unsecured to the front gusset section. The second end section also secures the rear panel to the rear gusset section along the second length of the second end section except for a short gap at which the rear panel is unsecured to the rear gusset section.

In accordance with another aspect of the method of this invention the front panel, and the rear panel each include respective inner surfaces which are heat sealed to each other along the intermediate seal line by a heated sealing bar.

In accordance with another aspect of the method of this invention the sealing bar has a width that extends beyond the outer fold edges of the bag to form the gaps inward of the outer fold edges and with each of the gaps being of a predetermined width.

In accordance with another aspect of the method of this invention the front panel and the rear panel each include respective inner surfaces and wherein the intermediate seal line includes peelable coating areas on the inner surfaces at the location of the gaps, whereupon internal pressure generated within the bag causes the peelable coating areas to break to thereby create the gaps.

In accordance with another aspect of the method of this invention a filter is provided in the vent space and over the valve to prevent any particulate material which enters the vent space from gaining ingress into the valve.

DESCRIPTION OF THE DRAWING

The invention will be described in conjunction with the following drawings in which like reference numerals designate like elements and wherein:

FIG. 4 is an enlarged sectional view taken along line 4-4 of FIG. 1;

FIG. 5 is a front plan view of a precursor of the package of FIG. 1 shown before the various transverse seal lines have been formed in the package;

FIG. 6 is a top plan view of a portion of the precursor package shown in FIG. 5 shown during a step in the process of producing the package of FIG. 1 wherein one exemplary heat sealing bar constructed in accordance with this invention is utilized to form the tortuous path;

FIG. 7 is a top plan view, like that of FIG. 6, but showing an alternative exemplary heat sealing bar constructed in accordance with this invention to form the tortuous path;

FIG. 8 is an isometric view, similar to FIG. 1, but showing an exemplary alternative embodiment of a package constructed in accordance with this invention for holding a particulate material which degasses, wherein the package includes plural tortuous paths for gas produced by the contents of the package to exit the package through a valve in the package, with the tortuous path minimizing the chances of the valve becoming clogged;

FIG. 9 is an enlarged sectional view taken along line 9-9 of FIG. 8;

FIG. 10 is an isometric view, similar to FIG. 7, but showing another exemplary embodiment of a package constructed in accordance with this invention for holding a particulate material which degasses, wherein the package includes plural tortuous paths for gas produced by the contents of the package to exit the package through a valve in the package, with the tortuous path minimizing the chances of the valve becoming clogged; and FIG. 11 is a front plan view, similar to FIG. 5, but of a portion of a precursor of the package of FIG. 10 shown before various transverse seal lines have been formed in the package.

DETAILED DESCRIPTION OF THE PREFERRED EMBODIMENT

Figure 1:
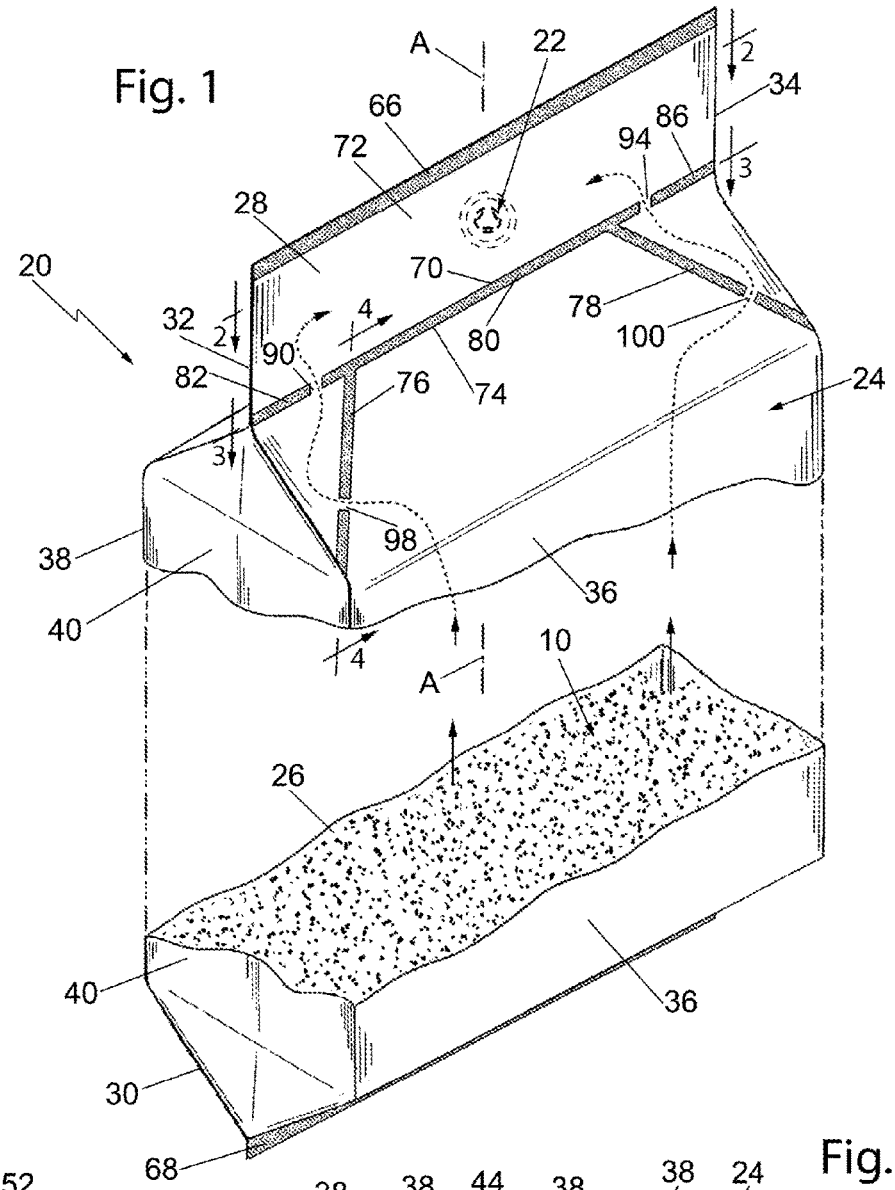
FIG. 1 is an isometric view, partially in section of one exemplary embodiment of a package constructed in accordance with this invention for holding a particulate material which degasses, wherein the package includes plural tortuous paths for gas produced by the contents of the package to exit the package through a valve in the package, with the tortuous path minimizing the chances of the valve becoming clogged.

Referring now to the various figures of the drawing wherein like reference characters refer to like parts, there is shown in FIG. 1 one exemplary embodiment of a package 20 constructed in accordance with one aspect of this invention. The package is arranged for holding a particulate material 10, e.g., fine powders, and includes a one-way degassing or pressure equalizing valve 22 to enable any gases produced by the particulate material to exit the package or to otherwise equalize the pressure within the package. In the exemplary embodiment shown the package 20 is in the form of a gusseted bag 24 formed of flexible sheet material bounding a hollow interior (compartment) 26 in which the particulate material 10 is located. It should be noted at this juncture that the bag may take other forms than a gusseted bag. For example it may be in the form of a flat bag or pouch.

As will be described in detail later the preferred embodiment of the invention the bag includes a least one intermediately located transverse seal which produces a tortuous path between the compartment 26 and the valve 22. That transverse seal incorporates discontinuities or gaps resulting in a tortuous path separating gas from particulate within the package. The intermediately located transverse seal with its gaps is especially effective and easily accomplished in gusseted bag construction, but can be accomplished in other types of bags. In any case, by placing small discontinuities or gaps in the seal lines made in constructing the bag from film or laminate, a tortuous path can be established, within which gasses flow to the valve 22 to escape the interior 26 of the package, while particulates rebound within the tortuous path and separate or precipitate out from the gas flow before reaching the valve. Those discontinuities or gaps can be located in a plurality of different areas and can be of different dimensions and shapes to establish the tortuous path. Consequently, the heat seal bars or other means used to make the heat seal lines establishing the tortuous path may also use a plurality of different sizes, shapes and dimensions to establish the tortuous path.

Figure 2:
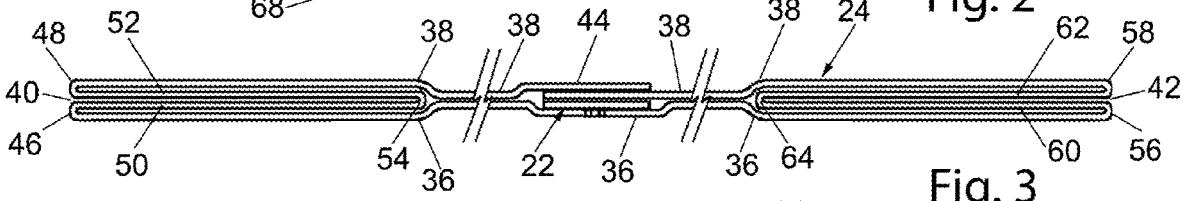
FIG. 2 is an enlarged sectional view taken along line 2-2 of FIG. 1.

Turning now to FIG. 1, the gusseted flexible package shown therein basically comprises the bag 24. The bag has a longitudinal axis A, a top portion 28, a bottom portion 30, a first side 32 and an oppositely disposed second side 34. The bag is formed of a flexible sheet material of any suitable construction, e.g., a film that may be a laminate of one or more plastic and/or metal layers. The bag includes a front panel 36, a rear panel 38, a first gusseted side panel 40, and a second gusseted side panel 42. The panels can be separate and secured together or preferably are in the form of a tube of the film material like shown in FIG. 5, wherein marginal edges of the tube of material overlap to form a longitudinally extending fin seal 44 (FIG. 2) extending along the axis A of the bag at the rear panel 38 and located at the center of the rear panel.

The first gusseted side panel 40 is located between and connected to the front panel 36 and the rear panel 38 at the first side 32 by a front outer fold edge 46 and a rear outer fold edge 48. The first gusseted side panel 40 comprises a front gusset section 50 and a rear gusset section 52 connected to each other by an inner fold edge 54 located centrally between the outer fold edges 46 and 48. The second gusseted side panel 42 is located between and connected to the front panel 36 and the rear panel 38 at the second side 34 by a front outer fold edge 56 and a rear outer fold edge 58. The second gusseted side panel comprises a front gusset section 60 and a rear gusset section 62 connected to each other by an inner fold edge 64 located centrally between the outer fold edges 56 and 58.

A top transversely extending seal line 66 is located within the top portion 28 of the bag, e.g., it extends across the top edge of the bag. The seal line 66 serves to seal the front, rear and gusseted side panels to each other to thereby close off the top of the bag. The seal line 66 can be created by various means, e.g., use of a heated sealing bar. If desired, a layer of a hot melt adhesive (not shown), or some other adhesive securement means, can be interposed between the outer surface of the front gusset section 50 and the rear gusset section 52 of the first gusseted side panel 40 at the top transversely extending seal line 66 to hold those gusset sections in engagement with each other. In a similar manner a layer of a hot melt adhesive (not shown), or some other adhesive securement means, can be interposed between the outer surface of the front gusset section 60 and the rear gusset section 62 of the second gusseted side panel 42 at the top transversely extending seal line 66 to hold those gusset sections in engagement with each other.

A bottom transversely extending seal line 68 (FIG. 1) is located within the bottom portion 30 of the bag, e.g., it extends across the bottom edge of the bag. The seal line 68 serves to seal the front, rear and gusseted side panels to each other to thereby close off the bottom of the bag. The seal line 68 can be created by various means, e.g., use of a heated sealing bar. A layer of a hot melt adhesive, or some other adhesive securement means, can be interposed between the outer surface of the front gusset section 50 and the rear gusset section 52 of the first gusseted side panel 40 at the bottom transversely extending seal line 68 to hold those gusset sections in engagement with each other. In a similar manner a layer of a hot melt adhesive, or some other adhesive securement means, can be interposed between the outer surface of the front gusset section 60 and the rear gusset section 62 of the second gusseted side panel 42 at the bottom transversely extending seal line 68 to hold those gusset sections in engagement with each other.

An intermediate seal line 70 extends across the bag 24 between the top transverse seal line 68 and the bottom transverse seal line 68, but located closer to the top transverse seal line. The panels 36, 38, 40, and 42 of the bag between the bottom transverse seal line 68 and the intermediate seal line 70 form the interior or compartment 26 of the package, which as mentioned above is configured for receipt of the particulate material 10 therein. The panels 36, 38, 40, and 42 of the bag between the intermediate seal line 70 and the top transverse seal line 66 form a vent space 72 in which the valve 22 is located, e.g., the valve is mounted centered in the front panel 36 in the vent space so that the inlet port of the valve is in fluid communication with the vent space 72. The outlet of the valve is in fluid communication with plural apertures 22A in the panel 36 and hence in fluid communication with the ambient atmosphere outside of the package.

Figure 3:
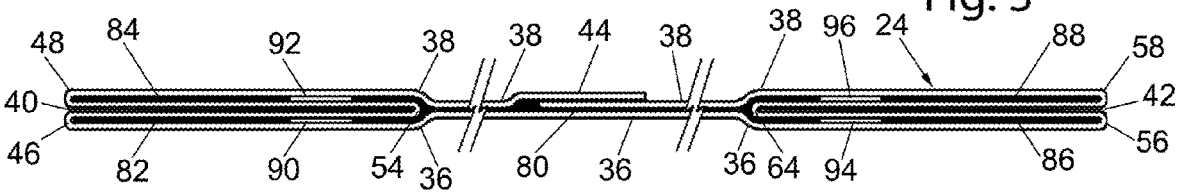
FIG. 3 is an enlarged sectional view taken along line 3-3 of FIG. 1.

As best seen in FIGS. 1 and 3 the intermediate seal line 70 basically comprises transversely extending seal section 74, a first angularly extending seal section 76 at the front panel, a similarly shaped and oriented second angularly extending seal section (not shown at the rear panel), a third angularly extending seal section 78 at the front panel, and a similarly shaped and oriented fourth angularly extending seal section (not shown at the rear panel). The transversely extending seal section 74 is best seen in FIG. 3 and basically comprises a central section 80, a first end section 82, a second end section 84, a third end section 86, and a fourth end section 88. The central section has a first end located at the inner fold edge 54 and a second end at the second inner fold edge 64. The central section 80 extends between the inner fold edges 54 and 64 and secures the front panel 36 to the rear panel 38 between the inner fold edges. The first end section 82 extends co-linearly from the first end of the central section 80 to the outer fold edge 46 at said first side. The first end section secures the front panel 36 to the front gusset section 50 of the first gusseted side panel along the length thereof except for a short discontinuity or gap 90 (FIGS. 1 and 3) at which the front panel 36 is unsecured to the front gusset section 50. The second end section 84 extends co-linearly from the first end of the central section 80 to the outer fold edge 48 at said first side. The second end section 84 secures the rear panel 38 to the rear gusset section 52 along the length thereof except for a short discontinuity or gap 92 (FIG. 3) at which the rear panel 38 is unsecured to the rear gusset section 52. The third end section 86 extends co-linearly from the second end of the central section 80 to the outer fold edge 56 at the second side. The third end section 86 secures the front panel 36 to the front gusset section 60 along the length thereof except for a short discontinuity or gap 94 (FIGS. 1 and 3) at which the front panel 36 is unsecured to the front gusset section 60. The fourth end section 88 extends co-linearly from the second end of the central section 80 to the outer fold edge 58 at said second side. The fourth end section 88 secures the rear panel 38 to the rear gusset section 62 along the length thereof except for a short discontinuity or gap 96 (FIG. 3) at which the rear panel 38 is unsecured to the rear gusset section 62.

Turning now to FIGS. 1 and 4 it can be seen that the first angularly extending seal section 76 extends downward at an angle, e.g., an acute angle, to the transversely extending section 82 and terminates at the outer fold edge 46 of the first gusseted side panel 40. The first angularly extending seal section 76 secures the front panel 36 to the front gusset section 50 of the first gusseted side panel 40 along the length of the first angularly extending seal section except for a short discontinuity or gap 98 (FIGS. 1 and 4) at which the front panel 36 is unsecured to the front gusset section 50. The second angularly extending seal section, is not shown, but is similar in shape, and orientation as the first angularly extending seal section. To that end, it extends downward at an angle, e.g., an acute angle, to the transversely extending section 70 and terminates at the outer fold edge 48 of the first gusseted side panel 40. The second angularly extending seal section secures the rear panel 38 to the rear gusset section 52 of the first gusseted side panel 40 along the length of the first angularly extending seal section except for a short discontinuity or gap (not shown) at which the rear panel 38 is unsecured to the rear gusset section 52. The gap in the second angularly extending seal section is located and constructed similarly to the gap 98 in the first angularly extending seal section 76. The third angularly extending seal section 78 extends downward at an angle, e.g., an acute angle, to the transversely extending section 70 and terminates at the outer fold edge 56 of the second gusseted side panel 42. The third angularly extending seal section 78 secures the front panel 36 to the front gusset section 60 of the second gusseted side panel 42 along the length of the third angularly extending seal section except for a short discontinuity or gap 100 (FIG. 1) at which the front panel 36 is unsecured to the front gusset section 60. The fourth angularly extending seal section, is not shown, but is similar in shape, and orientation as the third angularly extending seal section 78. To that end, it extends downward at an angle, e.g., an acute angle, to the transversely extending section 70 and terminates at the outer fold edge 58 of the second gusseted side panel 42. The fourth angularly extending seal section secures the rear panel 38 to the rear gusset section 62 of the second gusseted side panel 42 along the length of the fourth angularly extending seal section except for a short discontinuity or gap (not shown) at which the rear panel is unsecured to the rear gusset section. The gap in the fourth angularly extending seal section is located and constructed similarly to the gap 100 in the third angularly extending seal section 78.

As should be appreciated by those skilled in the art the intermediate seal line 70 with the gaps therein form a tortuous path between the compartment 26 and the vent space 72. Accordingly, gas can flow through the tortuous path from the compartment 26 to the vent space 72, as shown by the curved broken line arrows in FIG. 1, whereupon it enters the inlet port of the valve, from whence it passes through the valve to its outlet port from whence it passes through the apertures 22A into the ambient atmosphere. The tortuous path will block or at least impede the flow of particles to the valve, thereby protecting the valve from clogging.

The formation of the intermediate seal line 70 can be accomplished by any suitable means, e.g., the application of a heated sealing bar to the flexible material making up the bag, whereupon the portions of the inner surfaces of the panels under the heat sealing bar fuse together.

As best seen in FIG. 6 a preferred method of creating the discontinuities or gaps that form the tortuous path uses tooling including a heated seal bar 102 that extends beyond the transverse edges (i.e., the outer fold edges 54 and 56) of the bag 24 and locates the discontinuities some distance in from the edges of the bag. By making that distance greater than the tolerance for cross web registration of the film or bag on the production line, the width of the discontinuities or gaps will be constant regardless of bag registration changes on the line. The heat seal bar 102 may be constructed to include recesses 104 or other surface features at the location of the discontinuities or gaps so that when the heat sealing bar 102 is brought into engagement with the bag 24 the recesses in the sealing bar do not cause the inner surfaces of the panels at the location of the recesses in the sealing bar to fuse together, thereby leaving those gaps open or unsealed. Alternatively, as shown in FIG. 7, the inner surfaces of the panels making up the bag may include peelable coating areas applied to the internal sealant layer of the flexible package film to enable conventional heat seal apparatus to be used in forming the bag. In such a case the tooling may be a conventional solid sealing bar 106 whose dimensions are similar to the bar 102. Thus, the application of that sealing bar 106 will produce an intermediate seal line whose gaps are created when internal pressures of the bag exceed a certain limit and break open the coated, peelable sections of the seal lines.

As mentioned earlier previous solutions to prevent clogging of valves in flexible packaging have used filter media covering the valve and small sized passageways within the body of the valve to capture small particulate. These can be difficult or expensive to produce and often provide insufficient protection from small sized or large volumes of particulate contained in the bag. However, the packages of the subject invention by making use of a tortuous path within the seal lines of the package, internal gasses are free to travel to the valve, while particulates are captured in the path with no modifications or extra costs incurred to filter escaping gasses or protect the valve sealing surface. Moreover, by locating the discontinuities or gaps of the seal bar within the registration of the bag width as it travels down the production line, including tolerances for cross-web movement, and extending the seal bars beyond the edges of the bag, a uniform discontinuity (gap) width can be maintained.

In FIGS. 8 and 9 there is shown an alternative embodiment of a package 120 constructed in accordance with this invention and which is particularly suitable to allow for the trapping and collection of some powder residue after bag is filled, heat sealed closed, then laid down horizontally for palletization. The package 120 is constructed similarly to the package 20, except that the package 120 also includes a patch 122 of a filter material disposed over the valve. In the interest of brevity the construction features of the package 120 which are common with the features of the package 20 will be given the same reference numbers and the details of their construction, arrangement and operation will not be reiterated. The filter patch 122 serves to prevent any particulate material 26 that may have traversed the tortuous path and gained ingress into the vent space 72 in which the degassing valve 22 is located from clogging that valve. The filter patch 122 can be formed of any suitable material. For example, it can be in the form of a rectangular patch of spunbond nylon, flash-spun high-density polyethylene, filter paper, fabric, etc. One particularly useful material is TYVEK® spun-bonded olefin. The patch 122 of the exemplary embodiment is of generally rectangular shape and is located in the vent space 22 and is secured in a manner such that it overlies the inlet port of the valve 22 to prevent any particulate material from entering into that valve, since such action could clog or otherwise degrade the operation of the valve. Thus, in the exemplary embodiment the patch 122 is secured to the inner surface of the front panel 36 about the periphery of the patch so that the valve is sandwiched between the patch and the front panel 36.

Turning now to FIGS. 10 and 11 there is shown another alternative embodiment of a package 220 constructed in accordance with this invention, and which is also particularly suitable to allow for the trapping and collection of some powder residue after bag is filled, heat sealed closed, then laid down horizontally for palletization. Thus, the package 220 is constructed similarly to the package 120, except that the transverse seal line which separates the compartment 26 from the vent space 72 is of a different shape than that of the package 120. In the interest of brevity the construction features of the package 220 which are common with the features of the package 120 will be given the same reference numbers and the details of their construction, arrangement and operation will not be reiterated. To that end it can be seen that the intermediate seal line 70 basically comprises transversely extending central seal section 80, a first downwardly angularly extending seal section 76 at the front panel 36, a similarly shaped and oriented second angularly extending seal section (not shown) at the rear panel 38, a third angularly extending seal section 78 at the front panel, and a similarly shaped and oriented fourth angularly extending seal section (not shown) at the rear panel. The central section 80 has a first end located at the inner fold edge 54 and a second end at the second inner fold edge 64. The central section extends between the inner fold edges 54 and 64 and secures the front panel 36 to the rear panel 38 between the inner fold edges. Instead of the first end section 82 extending from the end of the central section 80 and being co-linear therewith, as is the case of the package 120, the first end section 82A of the package 220 extends from the first end of the central section at an acute angle to the longitudinal axis A and terminates at the top transversely extending seal line 66 at the side 32. Thus, the first end section 82A extends from the first end of the central section 80 to the outer fold edge 46 at said first side. The first end section 82A secures the front panel 36 to the front gusset section 50 of the first gusseted side panel along the length thereof except for a short discontinuity or gap 90A at which the front panel 36 is unsecured to the front gusset section 50. The second end section (not shown) of the package 220 is shaped and oriented like the first end section 82A and thus extends from the first end of the central section 80 to the outer fold edge 48 at said first side and secures the rear panel 38 to the rear gusset section 52 along the length thereof except for a short discontinuity or gap (not shown) at which the rear panel 38 is unsecured to the rear gusset section 52. The third end section 86A is a mirror image of the first end section 82A and thus extends from the second end of the central section 80 at an acute angle to the longitudinal axis A and terminates at the top transversely extending seal line 66 at the side 34. Thus, the third end section 86A secures the front panel 36 to the front gusset section 60 along the length thereof except for a short discontinuity or gap 94A at which the front panel 36 is unsecured to the front gusset section 60. The fourth end section (not shown) of the package 220 is shaped and oriented like the third end section 86A and thus extends from the second end of the central section 80 to the outer fold edge 58 at the second side and secures the rear panel 38 to the rear gusset section 62 along the length thereof except for a short discontinuity or gap (not shown) at which the rear panel 38 is unsecured to the rear gusset section 62.

As should be appreciated by those skilled in the art the various seal lines with the gaps therein of the package 220 form a tortuous path between the compartment 26 and the vent space 72. Accordingly, gas can flow through the tortuous path from the compartment 26 to the vent space 72, as shown by the curved broken line arrows in FIG. 10, whereupon it passes through the filter patch 122 to enters the inlet port of the valve, from whence it passes through the valve to its outlet port from whence it passes through the apertures 22A into the ambient atmosphere. Thus tortuous path will block or at least impede the flow of particles to the valve, thereby aiding the filter patch in protecting the valve from clogging.

As also mentioned earlier, the subject invention could also be used in flat pouches (or non-gusseted bags) where diagonal miter seals that provide strength and bag forming advantages in a gusseted bag, are included solely to create a tortuous path in a flat pouch bag. Thus, while the invention has been described in detail and with reference to specific examples thereof, it will be apparent to one skilled in the art that various changes and modifications can be made therein without departing from the spirit and scope thereof.

We claim:

1. A flexible package for holding a particulate material therein, said package comprising:

a one-way degassing or pressure equalizing valve; and a gusseted bag having a longitudinally extending axis, a top portion, a bottom portion, a first side, and an oppositely disposed second side, said first and second sides defining the width of said bag therebetween, said bag being formed of a flexible sheet material and comprising a front panel, a rear panel, a first gusseted side panel, a top transverse seal line, a bottom transverse seal line, and an intermediate seal line, said top transverse seal line being located in said top portion of said bag, said bottom transverse seal line being located in said bottom portion of said bag, said intermediate seal line being located between said top transverse seal line and said bottom transverse seal line and including a linear portion extending said width of said bag between said first side and said second side and perpendicularly to said longitudinally extending axis, said panels of said bag between said bottom transverse seal line and said intermediate seal line forming a compartment configured for receipt of the particulate material therein, said linear portion of said intermediate seal line, said top transverse seal line and said first and second sides being secured together to encircle and form a vent space that encompasses said width of said bag and in which said one-way degassing or pressure equalizing valve is located, said one-way degassing or pressure equalizing valve being in communication with said vent space and the ambient atmosphere outside of said bag, said first gusseted side panel being secured between said front panel and said rear panel at said first side by a pair of outer fold edges and comprising a front gusset section and a rear gusset section connected to each other by an inner fold edge located between said outer fold edges, said intermediate seal line comprising a central section, a first end section and a second end section, a first angularly extending end section, and a second angularly extending end section, said linear portion of said intermediate seal line comprising said central section, said first end section and said second end section, said first end section extending from said inner fold edge to one of said pair of outer fold edges and being collinear with said central section, said second end section extending from said inner fold edge to the other of said pair of outer fold edges and being collinear with said central section, said first angularly extending end section extending from said inner fold edge to said one of said pair of outer fold edges and being at an acute angle to said central section, said second angularly extending end section extending from said inner fold edge to said other of said pair of outer fold edges and being at an acute angle to said central section, said first end section including a short gap located between said inner fold edge and said one of said pair of outer fold edges, said second end section including a short gap located between said inner fold edge and said other one of said pair of outer fold edges, said first angularly extending end section including a short gap located between said inner fold edge and said one of said pair of outer fold edges, said second angularly extending end section including a short gap located between said inner fold edge and said other one of said pair of outer fold edges, said central section securing said panels together along said central section, said first end section securing said panels together along said first end section except for said short gap in said first end section at which said panels are unsecured to each other, said first angularly extending end section securing said panels together along said first angularly extending end section except for said short gap in said first angularly extending end section at which said panels are unsecured to each other, said second end section securing said panels together along said second end section except for said short gap in said second end section at which said panels are unsecured to each other, said second angularly extending end section securing said panels together along said second angularly extending end section except for said short gap in said second angularly extending end section at which said panels are unsecured to each other, said short gaps forming a tortuous path configured to enable gas to flow therethrough from said compartment to said vent space while reducing the chances of the particulate material gaining access to said valve.

2. The flexible package of claim 1, wherein said gusseted bag has a second gusseted side panel secured between said front panel and said rear panel at said second side by a pair of outer fold edges, said second gusseted side panel comprising a front gusset section and a rear gusset section connected to each other by an inner fold edge located between said outer fold edges of said second gusseted side panel, and wherein said intermediate seal line additionally comprises a third end section, a fourth end section, a third angularly extending end section, and a fourth angularly extending end section, said third end section extending from said inner fold edge of said second gusseted side panel to one of said pair of outer fold edges of said second gusseted side panel and being collinear with said central section, said fourth end section extending from said inner fold edge of said second gusseted side panel to the other of said pair of outer fold edges of said second gusseted side panel and being collinear with said central section, said third angularly extending end section extending from said inner fold edge of said second gusseted side panel to said one of said pair of outer fold edges of said second gusseted side panel and being at an acute angle to said central section, said fourth angularly extending end section extending from said inner fold edge of said second gusseted side panel to said other of said pair of outer fold edges of said second gusseted side panel and being at an acute angle to said central section, said third end section including a short gap located between said inner fold edge of said second gusseted side panel and said one of said pair of outer fold edges of said second gusseted side panel, said fourth end section including a short gap located between said inner fold edge of said second gusseted side panel and said other one of said pair of outer fold edges of said second gusseted side panel, said third angularly extending end section including a short gap located between said inner fold edge of said second gusseted side panel and said one of said pair of outer fold edges of said second gusseted side panel, said fourth angularly extending end section including a short gap located between said inner fold edge of said second gusseted side panel and said other one of said pair of outer fold edges of said second gusseted side panel, said short gaps in said second gusseted side panel forming a tortuous path configured to enable gas to flow therethrough from said compartment to said vent space while reducing the chances of the particulate material gaining access to said valve.

3. The flexible package of claim 1, wherein said panels include respective inner surfaces which are sealed to each other along said intermediate seal line except where said short gaps are located.

4. The flexible package of claim 1, wherein said front panel, said rear panel and said first gusseted side panel each include respective inner surfaces and wherein said intermediate seal line includes peelable coating areas on said inner surfaces at the location of said short gaps, whereupon internal pressure generated within said bag causes said peelable coating areas to break to thereby create said short gaps.

5. The flexible package of claim 2, wherein said front panel, said rear panel, said first gusseted side panel and said second gusseted side panel each include respective inner surfaces and wherein said intermediate seal line includes peelable coating areas on said inner surfaces at the location of said short gaps, whereupon internal pressure generated within said bag causes said peelable coating areas to break to thereby create said short gaps.

6. The flexible package of claim 1, additionally comprising a filter located within said vent space and configured to prevent any particulate material which enters said vent space from gaining ingress into said valve.

7. The flexible package of claim 2, additionally comprising a filter located within said vent space and configured to prevent any particulate material which enters said vent space from gaining ingress into said valve.

* * * * *